US007582031B2

(12) United States Patent
Runck

(10) Patent No.: US 7,582,031 B2
(45) Date of Patent: Sep. 1, 2009

(54) TENNIS BALL HOLDER

(76) Inventor: Willis Runck, 16501 KC Rd., New Ulm, MN (US) 56073

( * ) Notice: Subject to any disclaimer, the term of this patent is extended or adjusted under 35 U.S.C. 154(b) by 541 days.

(21) Appl. No.: 11/496,597

(22) Filed: Jul. 31, 2006

(65) Prior Publication Data

US 2008/0026879 A1 Jan. 31, 2008

(51) Int. Cl.
*A63B 69/00* (2006.01)

(52) U.S. Cl. ..... 473/459; 473/460

(58) Field of Classification Search ..... 473/459, 473/460, 473, 474; 294/19.2; 248/127, 129, 248/130, 133, 139–143; 206/315.9; 220/694; 211/14, 96; 414/434, 440
See application file for complete search history.

(56) References Cited

U.S. PATENT DOCUMENTS 1,708,579 A * 4/1929 Johnson ..... 248/126
D214,750 S * 7/1969 Hawkinson ..... D7/621
3,536,283 A * 10/1970 Lowe ..... 248/129
4,077,533 A * 3/1978 Meyer ..... 414/440
4,193,161 A * 3/1980 Scott ..... 15/352
4,252,490 A * 2/1981 Keller ..... 414/434
4,461,504 A * 7/1984 Perez et al. ..... 294/19.2
4,735,544 A * 4/1988 Stotts ..... 414/440
4,978,041 A * 12/1990 Richter ..... 222/608
5,368,351 A * 11/1994 Cuti ..... 294/19.2
5,860,658 A * 1/1999 Callahan ..... 280/30
5,868,366 A * 2/1999 Tubbs, Jr. ..... 248/133
5,890,686 A * 4/1999 Morales ..... 248/141
6,079,930 A * 6/2000 Valdes-Rodriguez ..... 414/440
6,302,460 B1 * 10/2001 Carr ..... 294/19.2
6,302,637 B1 * 10/2001 Andros ..... 414/421
6,398,040 B1 * 6/2002 Gregory ..... 211/14
7,229,085 B2 * 6/2007 Pederson et al. ..... 280/79.3
7,467,768 B1 * 12/2008 Vait ..... 248/133
2004/0016854 A1 * 1/2004 Hart ..... 248/141
2005/0236531 A1 * 10/2005 Joeckel ..... 248/133
2008/0026879 A1 * 1/2008 Runck ..... 473/459
2008/0217985 A1 * 9/2008 Botha ..... 298/11

FOREIGN PATENT DOCUMENTS

JP 06142249 A * 5/1994

* cited by examiner

*Primary Examiner*—Raleigh W. Chiu

(57) ABSTRACT

A tennis ball holder, including a frame having legs joined with at least one upper rail; a carriage having at least one support and a bin, the at least one support joined to the legs and being rotatably joined to the bin, the bin being rotatable within approximately a range of rotation, engaging the at least one upper rail at the extreme points of the range; and tennis balls disposed within the bin.

16 Claims, 2 Drawing Sheets

TENNIS BALL HOLDER

FIELD OF THE INVENTION

The present invention relates to devices to hold tennis balls and more particularly devices used to hold large volumes of tennis balls for practice sessions.

BACKGROUND OF THE INVENTION

Tennis is a game enjoyed by millions for exercise, sport and recreation. Many people choose to improve their game and will obtain the services of a tennis professional. Practice sessions with a professional, played on the court, typically involve the professional directing a ball toward the student for the student to hit. Hundreds of balls can be thrown in such a manner during the course of a session. As a result, professionals have found it necessary to have a large bin of tennis balls at their disposal for such session instead of one ball that is chased around after every swing.

Numerous products have been developed to aid the tennis professional in this regard. For instance, devices to pick up and hold tennis balls are described in U.S. Pat. Nos. 6,926,328; 6,494,340; 6,398,040; and 6,354,643 are a few examples. A drawback to all these devices is that they do not allow easy access to balls in the bottom of the bin. As the balls are depleted, the professional must reach deeper and deeper into the bin. A shallower bin is not an option as the bin should hold a sufficient amount of balls for a session.

What is needed is a tennis ball holder that alters its configuration such that the professional does not need to reach deeper and deeper as the balls are depleted. That is the tennis ball holder should be adjustable to lower an upper edge to an elevation commensurate with that of the bottom of the bin when the balls are nearly gone. The ball holder should have a mechanism that retains the balls in the altered configuration such that balls that are in the bin do not inadvertently fall out.

SUMMARY OF THE INVENTION

The present invention is a tennis ball holder that alters its configuration such that the professional does not need to reach deeper and deeper as the balls are depleted. That is the tennis ball holder is adjustable to lower an upper edge to an elevation commensurate with that of the bottom of the bin when the balls are nearly gone. The ball holder also has a mechanism that retains the balls in the altered configuration such that balls that are in the bin do not inadvertently fall out.

The present invention is a tennis ball holder which may include a frame joined to a carriage with tennis balls disposed in the carriage. The carriage may include a bin being rotatable within approximately a ninety-degree range between at least one upper rail of the frame. The bin preferably engaged the at least one upper rail at the extreme points of the rotational range. The bin is desirably fixable intermediate in the range via a selective lock to selectively preclude rotation.

The invention further includes a method of retaining and presenting tennis balls, having the steps of selectively locking a bin in an upright position intermediate a range of rotation; filling a bin with tennis balls; withdrawing tennis balls as desired; and unlocking the bin and rotating the bin to a tilted position as the balls are depleted.

Advantageously, the present tennis ball holder allows easy access to tennis balls within the bin such that the user does not have to reach down to the bottom of a deep bin.

As a further advantage, the bin is tiltable to better reach tennis balls in the bottom of the bin.

As still yet another advantage, the bin may have a stop that prevents balls from rolling out of the bin when in a tilted position.

Figure 1:
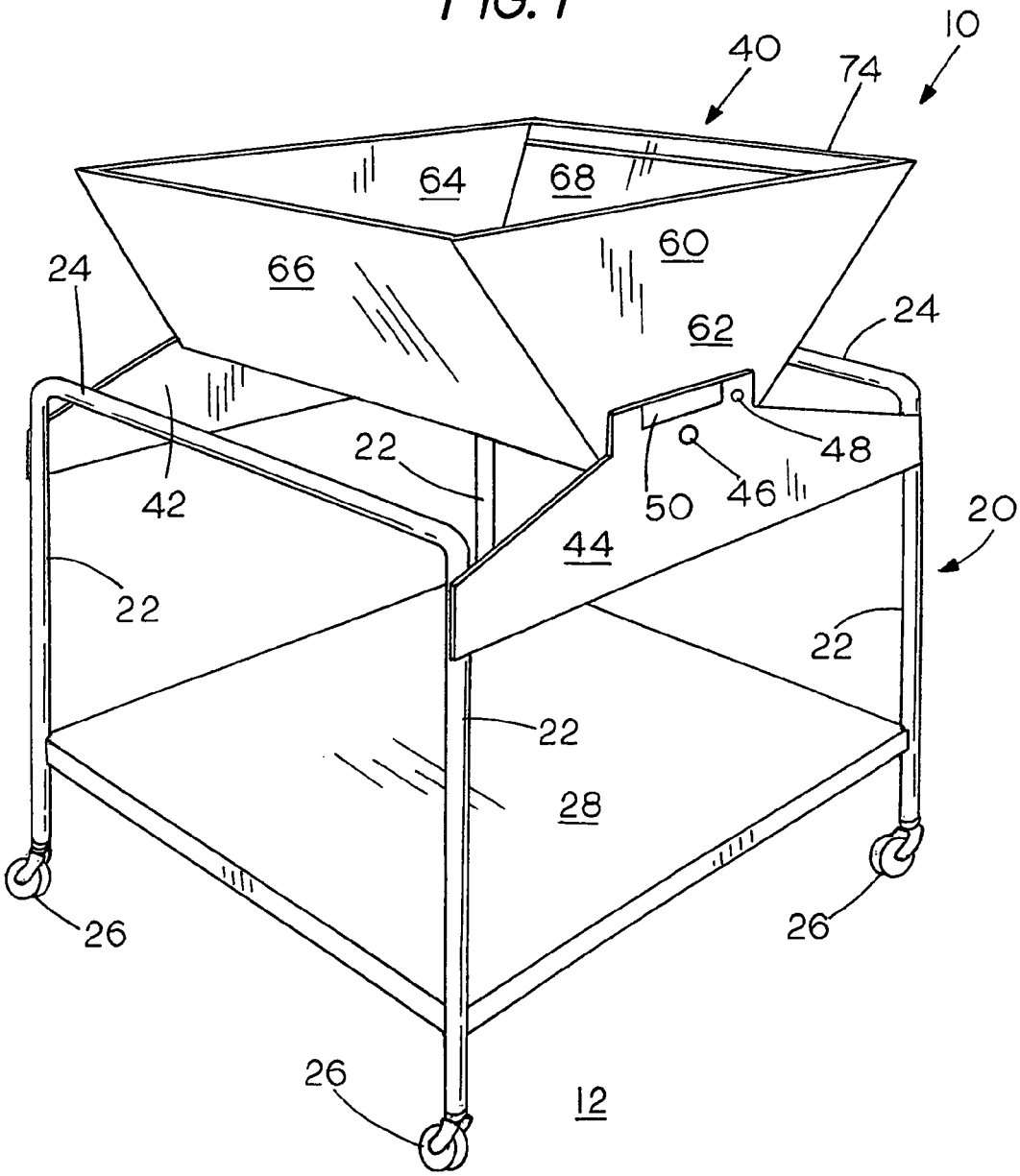
FIG. 1 is a perspective view of the tennis ball holder of the present invention with the bin in a locked position.
Figure 2:
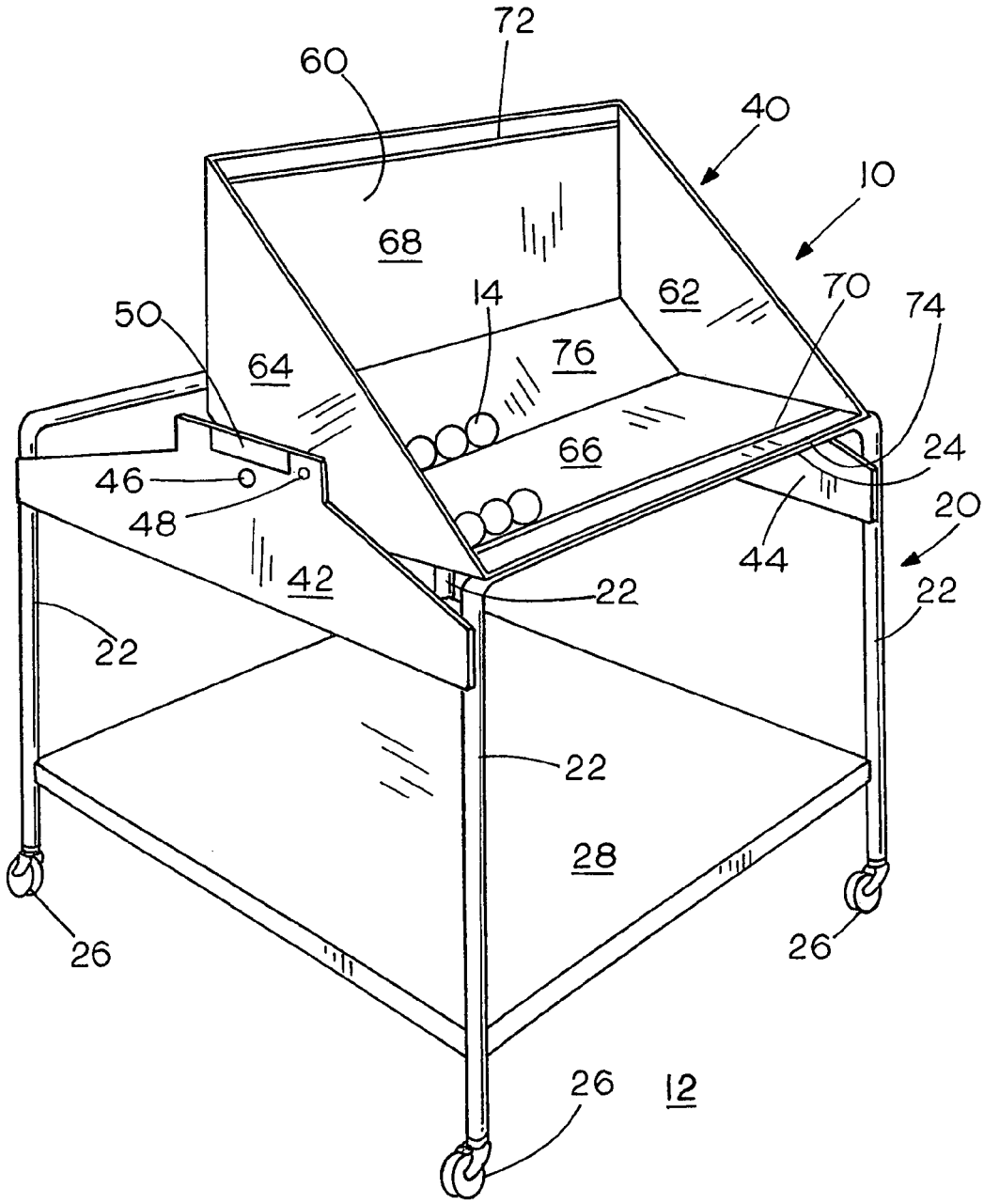
FIG. 2 is a perspective view of the tennis ball holder of the present invention showing the bin n a tilted position and tennis balls disposed in the bin.

The drawings are for illustrative purposes to show and describe the best mode of making and using the invention known at the time of filing. The drawings are not limiting to the invention and those skilled in the art will understand that departures may be made from the drawings without departing from the spirit and scope of the invention.

DETAILED DESCRIPTION

The present invention is a tennis ball holder 10 provided with a frame 20, a carriage 40 and optionally tennis balls 14. The tennis ball holder 10, for use in tennis training on a tennis court 12, is structured to ease the effort required to remove tennis balls 14 positioned deep within the bin 60 as the number of balls 14 in the bin 40 is being depleted. Each of the major components are described below with reference to the best mode of making and using the invention.

The frame 20 has legs 22 joined with at least one upper rail 24 and at least one tray 28. The legs 22 may be joined to castors 26 for ease of transport across a tennis court 12. In the preferred mode, the legs 22 are an inverted U-shaped piece of metal or other solid support material. In such configuration, the upper part of the inverted U forms an upper rail 24. Two such inverted U-shaped parts, provide a total of four legs 22 and two upper rails 24. The upper rails 24 aid in conjunction with other components in preventing the legs 22 from spreading or otherwise dislocating relative to the other legs 22 under the weight of the carriage 40 and the balls 14. Likewise, the tray 28 fixedly joins a lower portion of the legs 22, preventing the legs 22 from spreading or dislocating relative to each other. The tray 28 further provides a convenient area to place other equipment.

The carriage 40 may at least one support, preferably a first support 42 and second support 44, and is joined to the bin 60. The first and second supports 42,44 may join to the legs 22 functionally providing the same resistence to spreading that the upper rail(s) 24 provide. The first and second supports 42,44 rotatably join to the bin 60 with a pivot 46 and may fixedly join to the bin 60 with at least one selective lock 48. The at least one selective lock 48 is positioned to selectively preclude rotation of the bin 60, e.g. holding the bin 60, in an upright orientation, which is normally used when the bin 60 is full of tennis balls 14. The selective lock 48 may be disengaged to rotate the bin 60 to rest on an upper rail 24, preferably either side, lowering an upper edge 74 of the bin 60 such that the balls 14 at the bottom of the bin 60 are more easily accessed. The first and second supports 42,44 may be joined integrally or with attachment mechanism to at least one C-shaped handle 50.

The bin 60 may have first and second sidewalls 62,64 and first and second spill walls 66,68. The first and second spill walls 66,68 preferably are joined to first and second ball stops 70,72 respectively. The ball stops 70,72 are sized and positioned, generally toward the edge 74 of the bin 60 further the bottom 76, to retain tennis balls 14 within the bin 60 when the bin 60 is positioned at an extreme end of the rotational range.

The range of rotation is the area between the upper rails 24 in which the bin 60 can turn up to the point where the bin 60 is resting on an upper rail 24, which point is the extreme part of the rotational range. The bin 60, which may be trapezoidal shaped in cross section perpendicular to the axis of rotation may be rotatable within approximately a ninety-degree range engaging the at least one upper rail 24, either side, at the extreme points of the range. The degree of rotation is determinable in conjunction with the outward slant of the spill walls 66,68 of the bin 60 wherein the spill walls 66,68 are oriented horizontal to the ground or with a slight tip toward the bottom 76 of the bin 60 thereby retaining the tennis balls 14 within the bin 60. That is, as the spill walls 66,68 are more vertical when locked in the upright position, the range of rotation can exceed ninety degrees. When the spill walls 66,68 are more horizontal, the range of rotation may be less than ninety degrees. The bin 60 is desirably fixable intermediate in the range of rotation via the selective lock 48 to selectively preclude rotation. Tennis balls 14 may be disposed within the bin 60 for easy access to the tennis instructor.

In operation, the method of retaining and presenting tennis balls 14, may include the steps of selectively locking a bin 60 in an upright position intermediate a range of rotation; filling a bin 60 with tennis balls 14; withdrawing tennis balls 14 as desired; and unlocking the bin 60 and rotating the bin 60 to a tilted position as the balls 60 are depleted. The bin may be rested on an upper rail 24, precluding further rotation in the same direction of the tilt, when in the tilted position and the user may select the direction to rotate the bin 60.

The present invention has been described with reference to the preferred embodiment. This is not limiting as changes may be made in form and substance without departing from the spirit and scope of the legal rights this inventor is entitled to receive under the patent laws of the United States of America.

I claim:

1. A tennis ball holder, comprising:

a frame having legs joined with at least one upper rail and at least one tray, the legs being joined to castors;

a carriage having a first support, second support, and a bin, the first and second supports joined to the legs, the first and second supports rotatably joined to the bin with a pivot, the first and second supports being joined to at least one C-shaped handle, and the first and second supports joined to at least one selective lock positioned to selectively preclude rotation of the bin, the bin having first and second sidewalls, and first and second spill walls, the first and second spill walls further being joined to first and second ball stops respectively, the bin being rotatable within approximately a ninety-degree range engaging the at least one upper rail at the extreme points of the range, and the bin being fixable intermediate in the range via the selective lock to selectively preclude rotation; and tennis balls disposed within the bin.

2. A tennis ball holder, comprising:

a frame having legs joined with at least one upper rail;

a carriage having at least one support and a bin, the at least one support joined to the legs and being rotatably joined to the bin, the bin being rotatable within approximately a range of rotation, engaging the at least one upper rail at the extreme points of the range; and tennis balls disposed within the bin.

3. The device of claim 2 further comprising at least one tray joined to the legs.

4. The device of claim 2 further comprising castors joined to the legs.

5. The device of claim 2 further comprising a pair of upper rails, each upper rail joined to a pair of legs.

6. The device of claim 2 wherein the at least one support comprises a first support, second support.

7. The device of claim 2 further comprising pivot, the pivot rotatably joining the at least one support to the bin.

8. The device of claim 2 wherein the at least one support is joined to at least one C-shaped handle.

9. The device of claim 2 further comprising a selective lock, the selective lock positioned to selectively preclude rotation of the bin.

10. The device of claim 9 wherein the bin is fixable intermediate in the range via the selective lock.

11. The device of claim 2 wherein the bin comprises first and second sidewalls and first and second spill walls.

12. The device of claim 11 further comprising first and second ball stops joined to the first and second spill respectively, the first and second ball stops being sized and positioned to retain tennis balls within the bin when the bin is positioned at an extreme end of the rotational range.

13. The device of claim 2 wherein the range of rotation is approximately ninety degrees.

14. A method of retaining and presenting tennis balls, comprising the steps of:

selectively locking a bin in an upright position intermediate a range of rotation;

filling a bin with tennis balls;

withdrawing tennis balls as desired; and unlocking the bin and rotating the bin to a tilted position as the balls are depleted.

15. The method of claim 14 further comprising the step of resting the bin on an upper rail when in the tilted position, precluding further rotation in the same direction of the tilt.

16. The method of claim 14 further comprising the step of selecting the direction to rotate the bin.

* * * * *